United States Patent [19]

Malachowski

[11] Patent Number: 4,809,968

[45] Date of Patent: Mar. 7, 1989

[54] SIDE REGISTRATION WITH SUBTLE TRANSVERSE CORRUGATION

[75] Inventor: Michael A. Malachowski, Webster, N.Y.

[73] Assignee: Xerox Corporation, Stamford, Conn.

[21] Appl. No.: 171,262

[22] Filed: Mar. 21, 1988

[51] Int. Cl.[4] ..... B65H 9/16

[52] U.S. Cl. ..... 271/251; 271/188; 226/17; 226/88; 226/196

[58] Field of Search ..... 271/188, 240, 251, 252, 271/250, 248; 226/17, 88, 196

[56] References Cited

U.S. PATENT DOCUMENTS

| | | | |
|---|---|---|---|
| 3,762,700 | 10/1973 | Peterson et al. | 271/49 |
| 3,908,986 | 9/1975 | Bleau | 271/227 |
| 4,079,669 | 3/1978 | Nuborg | 271/268 X |
| 4,179,117 | 12/1979 | Rhodes, Jr. | 271/251 |
| 4,316,664 | 2/1982 | Nishimoto | 226/88 X |
| 4,316,667 | 2/1982 | Edwards et al. | 355/3 SH |
| 4,349,188 | 9/1982 | Young | 271/250 X |
| 4,401,302 | 8/1983 | Hardy et al. | 271/251 |
| 4,432,541 | 2/1984 | Clark et al. | 271/251 |
| 4,438,918 | 3/1984 | Ito et al. | 271/251 |
| 4,469,319 | 9/1984 | Robb et al. | 271/188 X |
| 4,621,801 | 11/1986 | Sanchez | 271/251 |
| 4,744,555 | 5/1988 | Naramore | 271/161 X |

*Primary Examiner*—Joseph J. Rolla
*Assistant Examiner*—Mona Beegle

[57] ABSTRACT

Side registering a sheet during forward movement of the sheet with lateral movement of the sheet causing one side edge of the sheet to engage a registration edge guide, by moving the sheet with skewed rollers providing a sheet engaging and driving nip, wherein the registration edge guide is substantially in one plane but has a small localized arcuate deformation out of that plane adjacent the nip, causing localized arcuate deformation of the sheet, the nip also being spaced from the plane by a corresponding amount, the localized arcuate deformation of the edge guide and the spacing of the nip providing localized bending of a portion of the sheet at the nip for improved side registering. The registration edge guide is preferably substantially linear V-shaped slot engaging one edge of the sheet therein and directing it toward a smooth bottom comprising only a small portion of the slot and lying substantially in the plane except at the localized arcuate deformation.

9 Claims, 4 Drawing Sheets

SIDE REGISTRATION WITH SUBTLE TRANSVERSE CORRUGATION

Cross reference is made to a copending application by the same assignee, U.S. Ser. No. 944,064 filed Dec. 22, 1986 by Raymond A. Naramore, et al., now U.S. Pat. No. 4,744,555.

The present invention relates to improved side registration of sheets of varying thickness, stiffness or weight, and is particularly suitable for the accurate and consistent side registration of different copy sheets while each copy sheet is being moved into registration with the image to be transferred thereto in a copier or printer. Side or lateral edge registration alignment and deskewing may be accomplished without stopping the forward movement of the sheet.

In the system disclosed herein, side edge alignment of a sheet against a side edge alignment guide is effected using a skewed feeding roller nip system in combination with a localized, subtle, sheet corrugation forming element aligned with the roll nip to give the sheet increased beam strength in the direction transverse to the principle or normal direction of sheet travel, i.e. in the sideways direction, towards the edge alignment guide.

By way of background, a registration system for original documents, in which nipped crossed-rollers with opposing skews and different materials are used for side registration into an edge guide in a document path but with a much larger diameter and much longer curve, in which substantially the entire document sheet is equally deformed, is disclosed in U.S.-A- Pat. No. 4,621,801 issued Nov. 11, 1986 to Hector J. Sanchez, incorporatd by reference. The description of such cross-roller operation therein is of particular interest to this case. Note especially column 17, lines 3–29. Cross-roll side edge registration is known in the art from said U.S. Pat. No. 4,621,801 and other references cited therein such as IBM U.S. Pat. No. 4,316,667 issued Feb. 23, 1982 to E. G. Edwards et al; U.S. Pat. No. 4,432,541 issued Feb. 21, 1984 to W. D. Clark et al; and U.S. Pat. No. 4,179,117 issued Dec. 18, 1979 to J. H. Rhodes, Jr.

However, such cross-rolled edge registration systems are quite critical as to the inherent delicate balancing of forces acting on the sheet, and the forces which the sheet can tolerate without loss of control or excess roll nip slippage, since the driving force system in the nip is normally designed to allow slippage in the direction of movement toward the registration edge after the copy sheet engages the registration edge without undesired or uncontrolled wrinkling or buckling of the sheet. That is especially difficult when lightweight sheets are being fed they require a low driving force to avoid these problems. On the other hand, when heavier weight or thicker sheets are being fed, a higher driving force may be required to overcome higher drag forces caused by sheet edge curl or other sheet feeding resistances.

Thus, there is a problem with cross-roll edge registration systems in particular, in that the high normal forces and drive forces needed to register heavy paper tend to overstress lightweight papers, which can even lead to sheet damage such as creasing, and or jamming of the sheets in the registration system, particularly if there is an additional problem of preexisting curl on the edge of the sheet.

In contrast, in the present system there is produced a small and only localized deformation or bump in the sheet just in the vicinity of the active roll nip, of a relatively small arcuate chord and diameter. That localized corrugation provided in the cross-feeding direction stiffens the sheet to strongly resist buckling as the sheet is being forced sideways against the side registration edge, for improved low paper weight or thin paper handling, as demonstrated in test results.

The disclosed system thus allows the use of known cross-roller drives which urge each sheet sideways from its skewed or misregistered position in a known manner against an edge guide, which is preferably an adjacent "V" or "U" shaped channel or slot along one path edge. However, the present invention is not limited to cross-roller drives and can be effectively used with other skewed roller or other side registration systems. It can be used for either copy sheets or original document sheets.

Corrugation of sheets in the opposite direction, in the direction of normal sheet movement, is of course well known, reference various references cited herein and U.S. Pat. No. 3,908,986 to Bleau (see FIG. 6); U.S. Pat. No. 4,401,302 to Hardy (see sheet 4); and U.S. Pat. No. 4,438,918 to Ito (see sheet 2).

U.S. Pat. No. 3,762,700 issued Oct. 2, 1973 to J. A. Peterson et al, shows a combination feed and alignment arrangement wherein active pivoting of an edge guide 22 by a separate mechanism, and intermittent engagement by a separate side edge registration wheel, is provided, both of which are undesirable. (Continuous engagement by a continuous nip acting thereon is preferred, for better and more positive sheet control.)

A single angled feed-roller drive adjacent a curved guide plate for the curving of a document is disclosed the Xerox Disclosure Journal Publication Vol. 8, No. 3, May/June, 1983, pgs. 255–257, by John H. Looney.

In the system disclosed herein, a single radius, arcuate deformation of the edge guide slot directly adjacent the skewed roll nip of two cross-skewed rollers is shown. However, alternative structures can be provided which can provide corresponding desirable localized subtle deformation of the sheet being side-registered by the roll nip into the edge guide slot. For example, two small arcuate deformations of the edge guide below the plane of the sheet and the nip, located immediately adjacent to the nip, on opposite sides of the nip, upstream and downstream of the nip, rather than one deformation in transverse alignment with the nip as shown in the drawings. In this alternative embodiment a small but effective "S" shaped wave curl or ripple is produced locally in the sheet in a direction perpendicular the registration wall.

In either embodiment, in the limited area where the sheet is being acted on by the deformation element and the nip, this is much more effective for side registration control than a large uniform curve as in U.S. Pat. No. 4,621,801 cited above. A large diameter and long curve can allow the edge of the sheet being side driven into the edge guide to deform, flare or even buckle, especially with lightweight sheets.

As xerographic and other copiers increase in speed, and become more automatic, it is increasingly important to provide higher speed yet more reliable and more automatic handling of both the copy sheets and the original or the document sheets being copied. It is desirable to feed and accurately register sheets of a variety of mixture of sizes, types, weights, materials, conditions and susceptibility to damage, yet with minimal jamming, time delays wear or damage by the sheet transporting and registration apparatus, even if the same sheets are automatically fed and registered repeatedly, as for recirculating document precollation copying.

The "document" here is the sheet (original or previous copy) being copied in the copier onto the "copy sheet", or "copy". In the description herein the term "document" or "sheet" refers to a usually filmsy sheet of paper, plastic, or other such conventional individual image substrate, and not to microfilm or electronic images which are generally much easier and faster to manipulate and reorder. However, the copy sheet can be generated from electronic or other image data other than an document sheet.

The present invention, which is claimed in the appended claims, overcomes various of the above-discussed and other problems, and provides various of the above noted features and advantages.

A specific feature of the embodiment disclosed herein is to provide an apparatus for side registering a sheet to a registration edge guide during forward movement of the sheet, with means for moving the sheet along a generally planar path with a forward direction of movement and a lateral direction of movement substantially normal to said forward direction, with said lateral movement of the sheet causing one side edge of the sheet to engage said registration edge guide so as to be aligned thereby with said registration edge guide, said means for moving the sheet comprising a sheet engaging and driving nip between rollers mounted adjacent said registration edge guide; the improvement wherein:

said registration edge guide is substantially in one plane for straightening a sheet, but has a small localized arcuate deformation out of said plane adjacent said nip, said localized arcuate deformation of said edge guide causing localized arcuate deformation of the sheet being aligned thereby out of said plane;

and wherein said nip is also spaced from said plane by an amount corresponding to the amount of said arcuate deformation of said edge guide from said plane;

said localized arcuate deformation of said edge guide and said corresponding spacing of said nip providing localized bending from said plane of a portion of the sheet, which is in said nip, for improved side registering of the sheet.

Further features provided by the system disclosed herein, individually or in combination, include those wherein said registration edge guide comprises a smooth-bottomed sheet edge confining slot which is generally linear and guides a sheet therein in a generally planar configuration, said registration edge guide slot having said small localized arcuate deformation smoothly integral thereof and localized directly adjacent said nip of said rollers; wherein said nip of said rollers is approximately at the level of the greatest extent of said arcuate deformation from said plane; wherein said registration edge guide comprises a substantially linear, smooth bottomed, V-shaped channel slot for engaging one edge of the sheet therein and directing said sheet edge toward said smooth bottom, said smooth bottom comprising only a small portion of said slot and lying substantially in said plane except at said localized acruate deformation; wherein said means for moving the sheet includes a first single pair of crossed-rollers, and further includes additional crossed-rollers spaced substantially upstream along said path from first crossed-rollers, said additional crossed-rollers having nips substantially in said plane and not adjacent to said localized arcuate deformation; wherein said nip is positioned approximately 1½ to 2 millimeters above said plane, and approximately 2.5 centimeters from said edge guide; wherein said V-shaped channel of said registration edge guide comprises thick nickel plated aluminum; in which closely spaced generally planar and parallel baffles are provided extending from said edge guide to flatten the sheet therebetween except at said localized arcuate deformation and said nip.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below. The present invention will be better understood by reference to this description of this embodiment thereof, inlcuding the drawing figures (approximately to scale), wherein.

Figure 1:
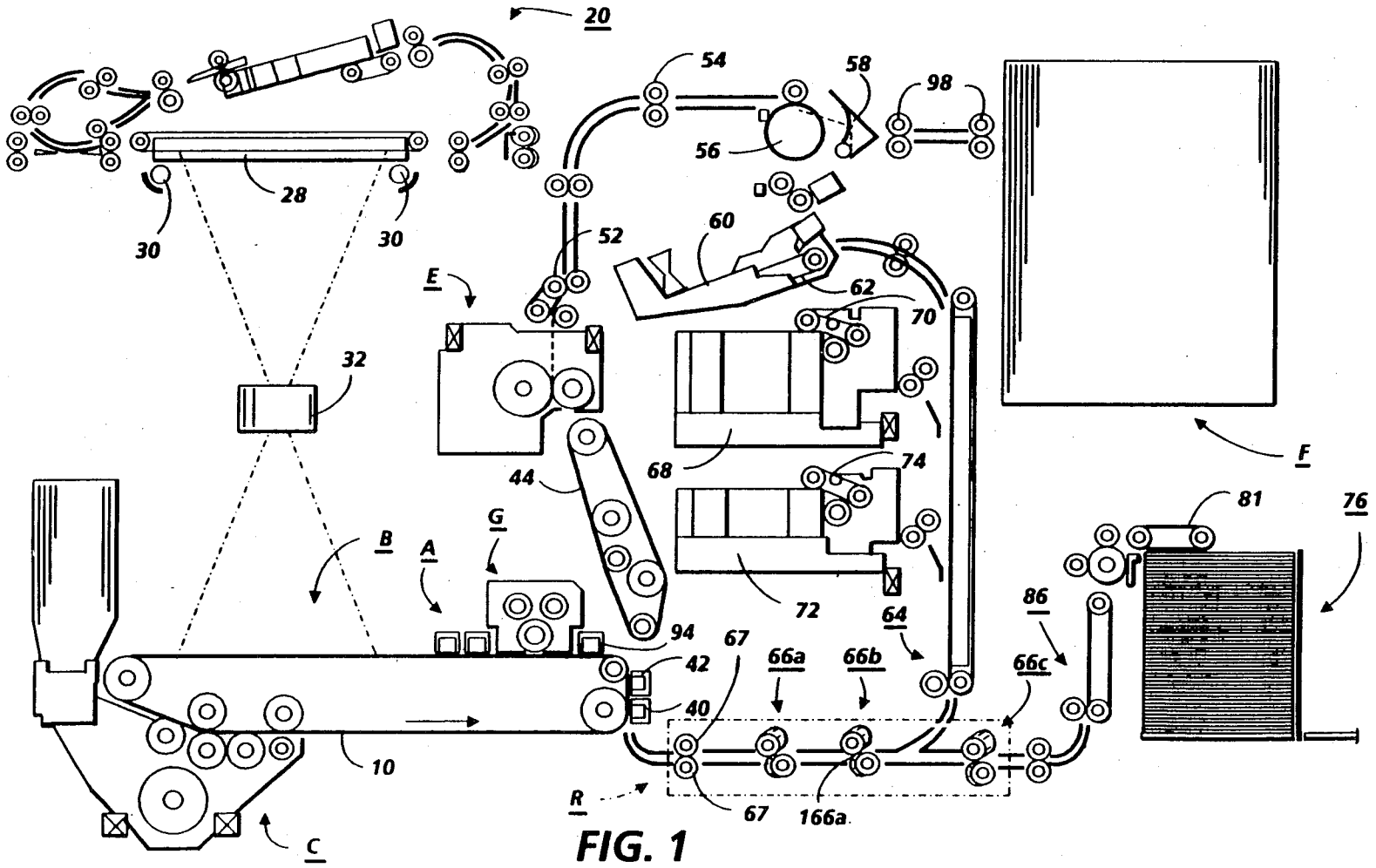
FIG. 1 is a frontal schematic view of an exemplary copier with an exemplary document handler 20 and a copy sheet side registration system "R" with which the subject system may be incorporated as further shown in the example of FIGS. 2–4.

Describing now in further detail the specific example illustrated in FIGS. 1–4, there is schematically shown in FIG. 1 an exemplary copier, with an exemplary document handling system 20 comprising a plural mode RDH 20. The copier may be of any known type, such as those disclosed in abovecited copier patents.

The RDH 20 provides for automatically transporting individual registered and spaced document sheets onto and over the conventional platen imaging station 28 of the copier, preferably using a belt platen transport overlying the platen 28. Documents are inputted to one end of the platen transport either from the RDH input provided by the restacking tray on top of the unit, spaced above the platen, or from the separate SADH document input directly adjacent one side of the platen, shown at the right side here. Further details of this example are shown in U.S. Ser. No. 029,027 filed Mar. 23, 1987 (D/86036). A side registration system as taught herein may be incorporated into the document paths thereof at suitable locations.

Referring to FIG. 1, the exemplary copier may be, for example, the well known Xerox Corporation "1075" or "1090" copiers, or any other xerographic or other copier, as illustrated and described in various patents cited above and otherwise, including U.S. Pat. No. 4,278,344 and others. The exemplary copier may conventionally include a photoreceptor belt 10 and the conventional xerographic stations acting thereon for respectively charging "A", image exposing "B", image developing with toner "C", transfer 40, detack 42, precleaning discharge 94, toner cleaning G, etc. Documents on the platen 28 and illuminated 30 may be imaged onto the photoreceptor 10 at area B through a variable reduction ratio optical imaging system 32 to fit the document images to the selected size of copy sheets.

The control of all copier and document handler and finisher operations is, conventionally, by the machine controller. The controller preferably comprises a known programmable microprocessor system, as exemplified by the prior art. Plural but interconnecting microprocessors at different locations may be used. The controller controls all of the machine steps and functions described herein, including all sheet feeding. This includes the operation of the document feeder 20, document and copy sheet gates, feeder drives, the finisher "F", etc. As further taught in those references, the controller also conventionally provides for storage and comparison of the counts of the copy and document sheets, the number of documents fed and recirculated in a document set, the desired number of copy sets, and other selections by the operator through a connecting panel of control switches are utilized to help keep track of the position of the document and the copy sheets and the operative components of the apparatus by connection to the controller. For example, the controller may be conventionally connected to receive jam, timing or positional and other control signals from various document sheet sensors in the document recirculation path. In addition, the controller variably regulates the positions of sheet path selection gates depending upon which mode of operation is selected and the status of copying in that mode. The controller also conventionally operates and changes displays on a connecting instructional display panel portion thereof.

Referring now further to the exemplary copier of FIG. 1, the copier is conventionally adapted to provide either duplex or simplex precollated copy sets copied from either duplex or simplex original documents presented by the RDH 20, or another image input, on various type of copy sheets. Two separate copy sheet trays 68 and 72 are provided, for feeding (70, 74) clean copy sheets from either one selectably, plus a high capacity paper feeder 76 shown at the lower right hand side here with a separate sheet input path 96. The copy sheets are fed 81 from the high-cap feeder 76 via paper path 86, or from a selected one of the paper trays 68 or 72 via a paper path 64, to the registration system R. From there the sheets are fed to transfer station 40, for the conventional transfer of the xerographic toner image of document images from the photoreceptor to one side of the copy sheet. The copy sheets are then fed by a vacuum transport 44 to a roll fuser "E" for the fusing of that toner image thereon. From the fuser E, the copy sheets are fed through a sheet decurler 52. The sheets may pass directly on without inversion into the output path 98 of the copier to the finishing module "F", or be deflected into a duplex inverting transprot 56, 58 which stacks copy sheets to be duplexed into a duplex buffer tray 60. For the completion of duplex copying, the copy sheets in the tray 60 are fed seriatim by its bottom feeder 62 back to the sheet path 64 and through side registration system "R" for the imaging of their second or opposite side page image.

Figure 2:
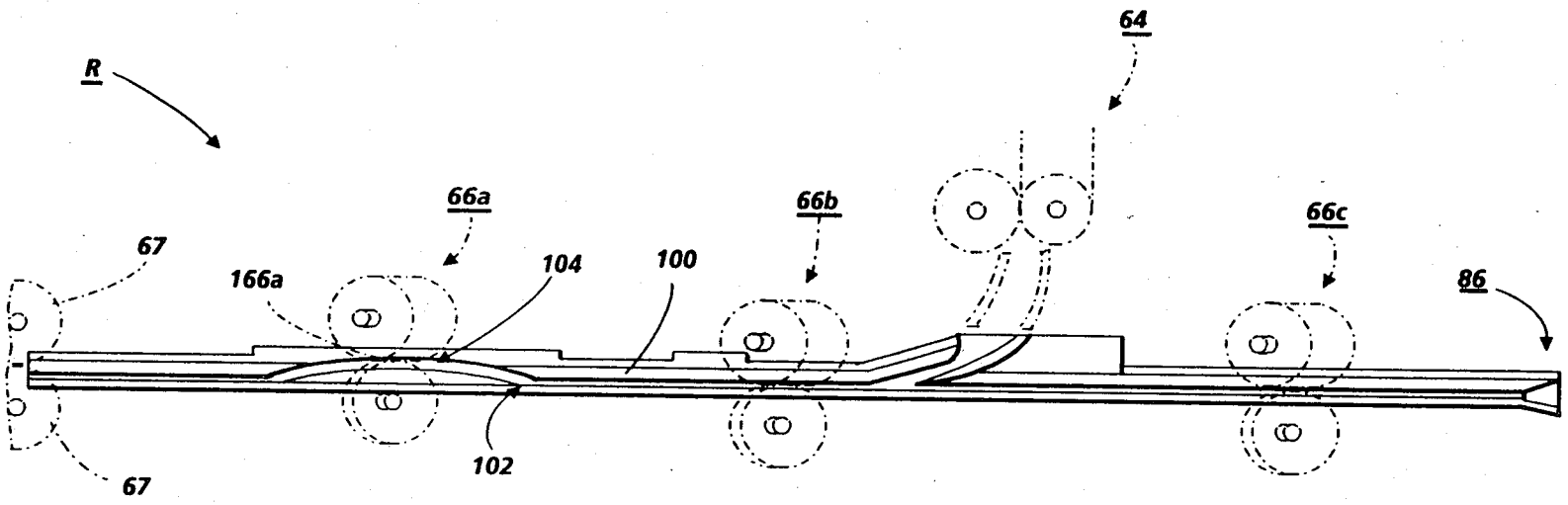
FIG. 2 is an enlarged partial frontal view of the side registration system "R" of FIG. 1.
Figure 3:
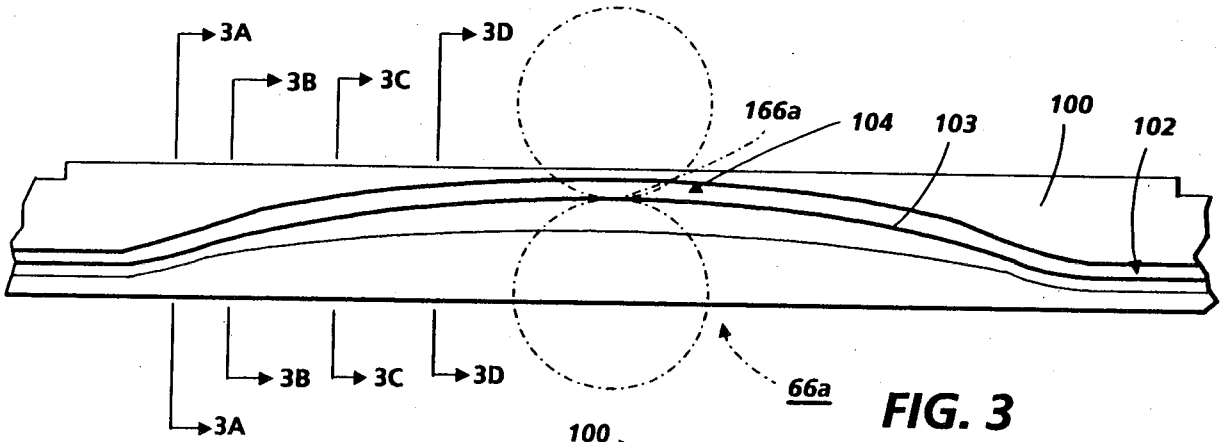
FIG. 3 is an enlarged view taken along the lines 3—3 in FIG. 4 of a key portion of the side registration system "R" of FIG. 1; with respective indicated cross-sections 3A–3D.
Figure 3A:
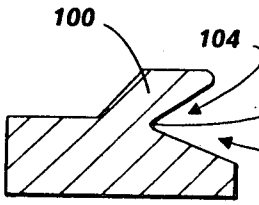
Figure 3B:
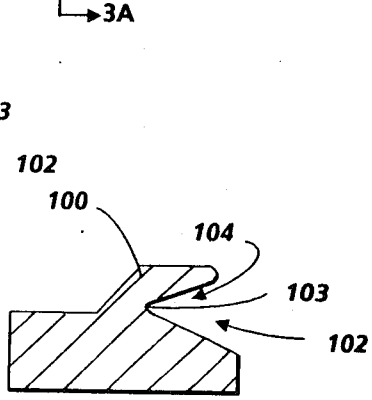
Figure 3C:
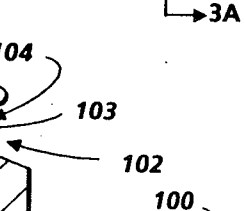
Figure 3D:
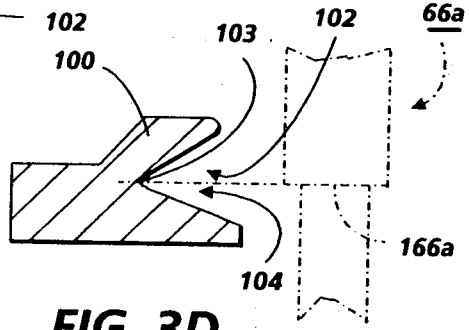
Figure 4:
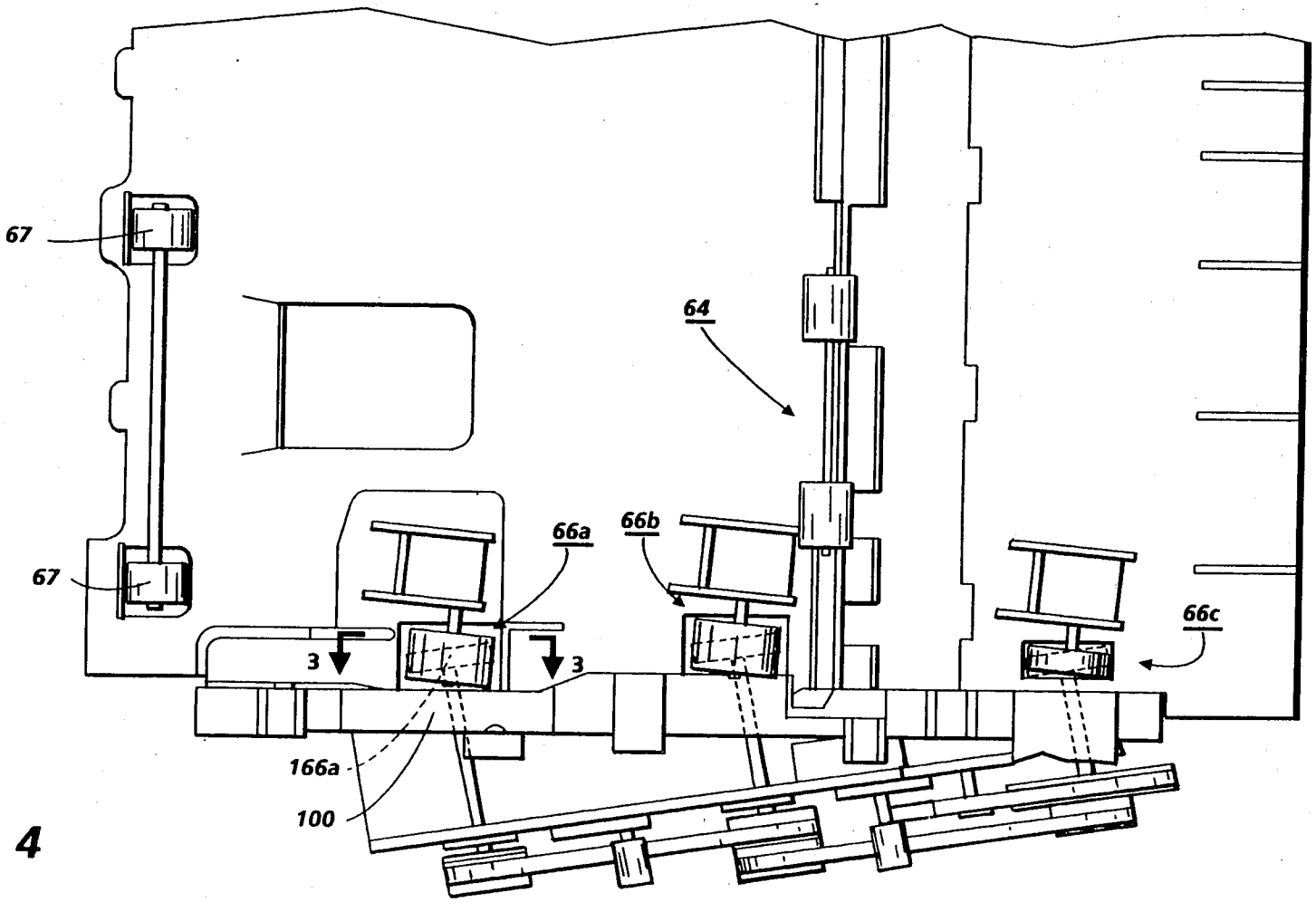
FIG. 4 is a top view of the embodiment of FIGS. 2–3.

Turning now to the registration system "R" disclosed herein, and FIGS. 2–4, a key element is the side guide 100 and its groove or slot 102 providing sheet edge registration and deskewing in it's bottom 103, and particularly the small arcuate deformation 104 therein shown especially in the enlarged partial view of FIG. 3 and its cross-sections 3A–3D. Cooperating therewith in position and function is the cross-roller pairs 66*a* and its nip 166*a*. These are shown in FIGS. 3 and 3D in phantom to illustrate the relative positions.

Downstream of the cross-rollers 66*a* is a spaced pair of non-slip, non-skewed roller pairs 67 for taking the deskewed sheet into the transfer station 40, without allowing further sheet side movement. These rollers 67 may be servo-controlled for sheet registration in the downstream, principal (normal) sheet movement direction. Upstream of the cross-rollers 66*a* are additional cross-rollers 66*b* and 66*c* for initial gross side registration movement of sheets from the two input paths 64 and 86. These rollers 66*b* and 66*c* are spaced sufficient upstream of rollers 66*a* so that their roll nips can release the sheet after roll nip 166*a* has started to act on the sheet, i.e. so that nip 166*a* provides the sole final driving force on the sheet for side registration and deskewing. The top roller of the rolls 66*a* can be steel and the bottom roller urethane, at conventionally cross-skewed angles as shown and described in said U.S. Pat. No. 4,621,801,for example.

The registration edge guide sheet edge confining slot 102 is generally linear and guides a sheet therein in a generally planar configuration. The cross-roll nip 166*a* drives the sheet forward but also sideways into the bottom 103 of the groove or slot 102 of the side guide 100. Here this is a continuously smooth-bottomed, heavy nickel plated aluminum "V" shaped groove, generally linear except at the small corrugating deformation 104, where the groove 102 makes a smooth arcuate curve away from and back to the normal line and plane of the slot 102. The shape of the groove guides the sheet edge into the narrow bottom 103, which is a wearresistant and low friction surface.

In this apparatus R for side registering a sheet to a registration edge guide 100 during forward movement of the sheet, the sheet is driven along a path with a forward direction of movement and a lateral direction of movement substantially normal to said forward direction, with the lateral movement of the sheet causing one side edge of the sheet to engage said registration edge guide so as to be aligned thereby. The means for moving the sheet comprises rollers providing a sheet engaging and driving nip between a driving roller and an idler roller, mounted adjacent the registration edge guide.

The registration edge guide 100 is substantially in one plane for straightening a sheet, but has a small localized arcuate deformation 104 out of this plane adjacent the nip 166*a*. This localized arcuate deformation 104 of the edge guide causes localized arcuate deformation of the sheet being aligned thereby, deformed out of the plane. The nip 166*a* is also spaced from the plane by an amount corresponding to the amount of the arcuate deformation of the edge guide from the plane. This localized arcuate deformation of the edge guide slot and the corresponding positioning or spacing of the nip, provides localized bending from the normal plane of the portion of the sheet in the nip, for improved side registering of the sheet. The nip 166*a* of the cross-rollers 66*a* is approximately in the plane of the greatest extent of said arcuate deformation 104 from said plane of said edge guide slot bottom 103.

The means for moving the sheet includes besides the first single pair of cross-rollers 66*a*, additional cross-rollers 66*b*, 66*c* spaced upstream along the path the from first cross-rollers 66*a*. Unlike 66*a*, these additional cross-rollers 66*b*, 66*c* have nips substantially in the normal sheet plane, and are not adjacent to the localized arcuate deformation 104. All the bottom rolls of the pairs 66*a*, 66*b*, 66*c* may be commonly continuously driven, as shown in FIG. 4, and continuously nipped by their opposing idler rolls, as shown.

Closely spaced generally planar and parallel baffle plates are also preferably provided extending from the edge guide to flatten the sheet therebetween except at said localized arcuate deformation 104 and said nip 166*a*. These are generally conventional paper path baffles and need not be illustrated here.

It has been found that appropriate and effective approximate dimensions for the illustrated system are as follows. The cross-roll nip 166*a* may be spaced from the bottom or edge alignment surface 103 of the edge guide 100 by approximately 2.5 centimeters transverse the primary sheet movement direction, and approximately 1.5 to 2 millimeters above the normal plane of the sheet and said surface, substantially the same distance above said plane as the maximum arcuate deflection of slot deformation 104.

While the embodiments disclosed herein are preferred, it will be appreciated from this teaching that various alternatives, modifications, variations or improvements therein may be made by those skilled in the art, which are intended to be encompassed by the following claims:

What is claimed is:

1. In apparatus for side registering a sheet to a registration edge guide during forward movement of the sheet, with means for moving the sheet along a generally planar path with a forward direction of movement and a lateral direction of movement substantially normal to said forward direction, with said lateral movement of the sheet causing one side edge of the sheet to engage said registration edge guide so as to be aligned thereby with said registration edge guide, said means for moving the sheet comprising a sheet engaging and driving nip between rollers mounted adjacent said registration edge guide; the improvement wherein:

said registration edge guide extends substantially along one plane for straightening a sheet, but has a small localized arcuate deformation out of said plane adjacent said nip, said localized arcuate deformation of said edge guide casing localized arcuate deformation of the sheet being aligned thereby out of said plane;

and wherein said nip is also spaced from said plane by an amount corresponding to the amount of said arcuate deformation of said edge guide from said plane;

said localized arcuate deformation of said edge guide and said corresponding spacing of said nip providing localized bending from said plane of a portion of the sheet, which is in said nip, for improved side registering of the sheet.

2. Apparatus for side registering a sheet according to claim 1, wherein said registration edge guide comprises a smooth-bottomed sheet edge confining slot which is generally linear and guides a sheet therein in a generally planar configuration, said registration edge guide slot having said small localized arcuate deformation is smoothly integral thereof and localized directly adjacent said nip of said rollers.

3. Apparatus for side registering a sheet according to claim 1, wherein said nip of said rollers is approximately at the level of the greatest extent of said arcuate deformation from said plane.

4. Apparatus for side registering a sheet according to claim 1, wherein said registration edge guide comprises a substantially linear, smooth bottomed, V-shaped channel slot for engaging one edge of the sheet therein and directing said sheet edge toward said smooth bottom, said smooth bottom comprising only a small portion of said slot and lying substantially in said plane except at said localized acruate deformation.

5. Apparatus for side registering a sheet according to claim 1, wherein said means for moving the sheet includes a first single pair of crossed-rollers, and further includes additional crossed-rollers spaced substantially upstream along said path from first crossed-rollers, said additional crossed-rollers having nips substantially in said plane and not adjacent to said localized arcuate deformation.

6. Apparatus for side registering a sheet according to claim 1, wherein said nip is positioned approximately $1\frac{1}{2}$ to 2 millimeters above said plane, and approximately 2.5 centimeters from said edge guide.

7. Apparatus for side registering a sheet according to claim 4, wherein said V-shaped channel of said registration edge guide comprises thick nickel plated aluminum.

8. Apparatus for side registering a sheet according to claim 1, in which closely spaced generally planar and parallel baffles are provided extending from said edge guide to flatten the sheet therebetween except at said localized arcuate deformation and said nip.

9. Apparatus for side registering a sheet according to claim 1; wherein said registration edge guide comprises a smooth-bottomed "V" shaped sheet edge confining slot which is generally linear and guides a sheet therein in a generally planar configuration, said registration edge guide slot having said small localized arcuate deformation which is smoothly integral thereof and localized directly adjacent said nip of said rollers; wherein said nip of said rollers is approximately in the plane of the greatest extent of said arcuate deformation from said plane; and wherein said means for moving the sheet includes a first single pair of crossed-rollers, and further includes additional cross-rollers spaced upstream along said path from first crossed-rollers.

* * * * *